US006506023B1

(12) United States Patent
Chien et al.

(10) Patent No.: US 6,506,023 B1
(45) Date of Patent: Jan. 14, 2003

(54) INTEGRALLY FORMED STAMPING SHEET-METAL BLADES HAVING 3D STRUCTURE

(75) Inventors: Huan-Jan Chien, Hsinchu (TW); Yee-Ren Chen, Hsinchu (TW); Jing-Fuh Chen, ChangHua (TW); Rong-Jau Liaw, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 58 days.

(21) Appl. No.: 09/654,900

(22) Filed: Sep. 5, 2000

(51) Int. Cl.[7] ..... F04D 29/30

(52) U.S. Cl. ..... 416/186 R; 416/213 A; 416/DIG. 3

(58) Field of Search ..... 416/185, 186 R, 416/183, 188, 213 A, 223 B, DIG. 3; 29/889, 889.4

(56) References Cited

U.S. PATENT DOCUMENTS 629,121 A * 7/1899 Bicalky ..... 29/889.4
2,899,129 A * 8/1959 Schwaiger ..... 416/DIG. 3
4,502,837 A * 3/1985 Blair et al. ..... 416/183

FOREIGN PATENT DOCUMENTS

JP 58-133498 A * 8/1983 ..... 416/186 R
SU 423944 A * 9/1974 ..... 416/DIG. 3
SU 1267058 A * 10/1986 ..... 416/DIG. 3

* cited by examiner

*Primary Examiner*—Christopher Verdier
(74) *Attorney, Agent, or Firm*—Troxell Law Office PLLC

(57) ABSTRACT

Integrally formed stamping sheet-metal blades having 3D structure for impeller or diffuser of a centrifugal pump or blower includes at least two integral forming blade or vane members. Each blade or vane member has a plurality of relatively short 3D blades or vanes extending radially outward and an engaging edge of selected shape. Two or more blade or vane members may be positioned and stacked together through mating the engaging edge and be spot welded to form a complete impeller or diffuser assembly. The blade or vane may be joined to form a completed smooth blade or vane, or may be spaced from each other to form a multi-row blade or vane assembly. The impeller and vane assembly may be made with less number of stamping molds and jigs. Production is less expensive. Positioning and assembly of the blade and vane is easier at a lower cost.

16 Claims, 8 Drawing Sheets

INTEGRALLY FORMED STAMPING SHEET-METAL BLADES HAVING 3D STRUCTURE

FIELD OF THE INVENTION

This invention relates to integrally formed stamping sheet-metal blades having 3D structure and particularly to 3D metal working blades for an impeller or diffuser of centrifugal pumps and blowers.

BACKGROUND OF THE INVENTION

Conventional impellers and diffusers used in pumps or blowers are generally made by casting or metal working. Products made by casting usually are bulky and heavy, have poorer material properties and often create pollution problems in the production process, hence have gradually been replaced by metal working products.

3D metal working blades and vanes may be formed with accurate curved profile and have improved fluid passage and loading distribution, and may result in enhanced pumping efficiency. It is therefore widely used in high efficiency centrifugal pumps nowadays.

However conventional metal working techniques cannot produce integral blades or vanes with accurate 3D curved profiles. Each blade has to be produced one piece at a time separately, then be positioned and soldered individually between the front and rear covers of the impeller to form a complete impeller or diffuser. The production cost is high, and production time and process are long and tedious. It is because an accurate 3D curved profile for the blades and vanes is difficult or impossible to make integrally by conventional stamping process.

Conventional stamping processes now available can only produce integral forming blades or vanes of simple 2D profile for low priced products. It cannot make accurate 3D curved profile for the blades and vanes needed for high performance pumps and blowers.

To produce accurate 3D profile blades and vanes, the contemporary method is to make each blade and vane individually, then assemble the blades and vanes to a complete impeller or diffuser. It needs a lot of different molds and jigs. Production cost is high. Assembly is difficult and costly.

Furthermore for some special purpose pumps such as those for improved de-swirl function or increased pumping pressure, they need an impeller or diffuser of multi-row blades. U.S. Pat. Nos. 5,310,309, 4,877,370, 5,417,547, 5,516,263 and 4,354,801 have disclosed such examples. Multi-row blades mostly can only be produced by a casting process to form the required 2D curve for creating desirable fluid passage and meeting loading requirement. To produce 3D metal working blades will greatly increase the blades number. The cost of production becomes too high. There are still rooms for improvement.

SUMMARY OF THE INVENTION

It is an object of this invention to provide integrally formed stamping sheet-metal blades having 3D structure that may substitute a plurality of individually made conventional blades to form a complete blade member by a relatively few number of assemblies and that have accurate 3D curved profile to enhance pumping efficiency at a lower production cost and less production time.

It is another object of this invention to provide integrally formed stamping sheet-metal blades that may form a multi-row blade structure with accurate 3D curved profile for producing improved pumping efficiency at a lower assembly time and cost.

In one aspect, the integrally formed stamping sheet-metal blades having 3D structure of this invention includes at least two integral forming blade members. Each blade member has a plurality of relatively short 3D curved blades and engaging means. The engaging means may facilitate positioning and engagement of the blade members to become a final and complete 3D curved blades or spaced multi-row blades assembly. As the complete 3D curved blades assembly is formed by a few numbers of relatively short blades members, total blade number is greatly reduced. The number of molds and jigs that are needed is also reduced. Assembly and production become easier and faster. Product cost is lower. Multi-row blades structure by metal working process may become possible and less expensive.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

This invention aims at providing a plurality of integrally formed sheet-metal blades of relatively short length by a stamping operation. Then two or more of the integrally formed stamping sheet-metal blades having 3D structures may be engaged to form a complete impeller or diffuser, or to form a multi-row blade structure. As the complicated 3D curved profile of the complete blade is divided into two or more shorter blade sections, a stamping operation for producing the integral multiple blades becomes possible. The conventional technique of producing each blade by stamping operation then assembling the blades to a complete impeller or diffuser may be dispensed with. It saves a lot of molds and jigs for producing the blades. Production time and cost may be greatly reduced. Fluid passage design and construction of the impeller and diffuser may be made easier and more flexible at a lower cost.

Referring to FIGS. 1A through 3C, an impeller made by the present invention includes an inner blade member 1 and an outer blade member 2. Both the inner and outer blade members 1 and 2 are respectively made by an integral stamping process. Of course the impeller may include three or more blade members if desired.

Figure 1C:
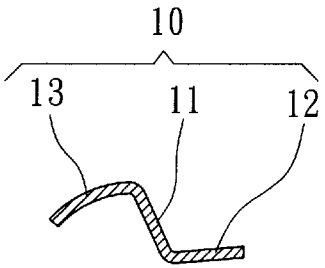
FIG. 1C is a crosssectional view taken on line 91—91 of FIG. 1.
Figure 1B:
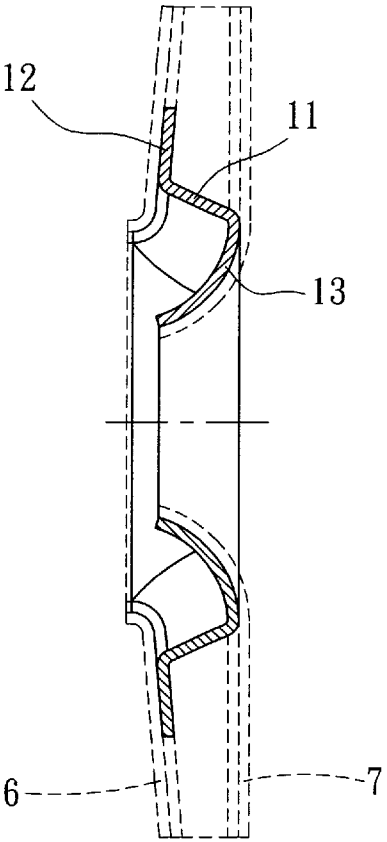
FIG. 1B is a crosssectional view taken on line 81—81 of FIG. 1.
Figure 1A:
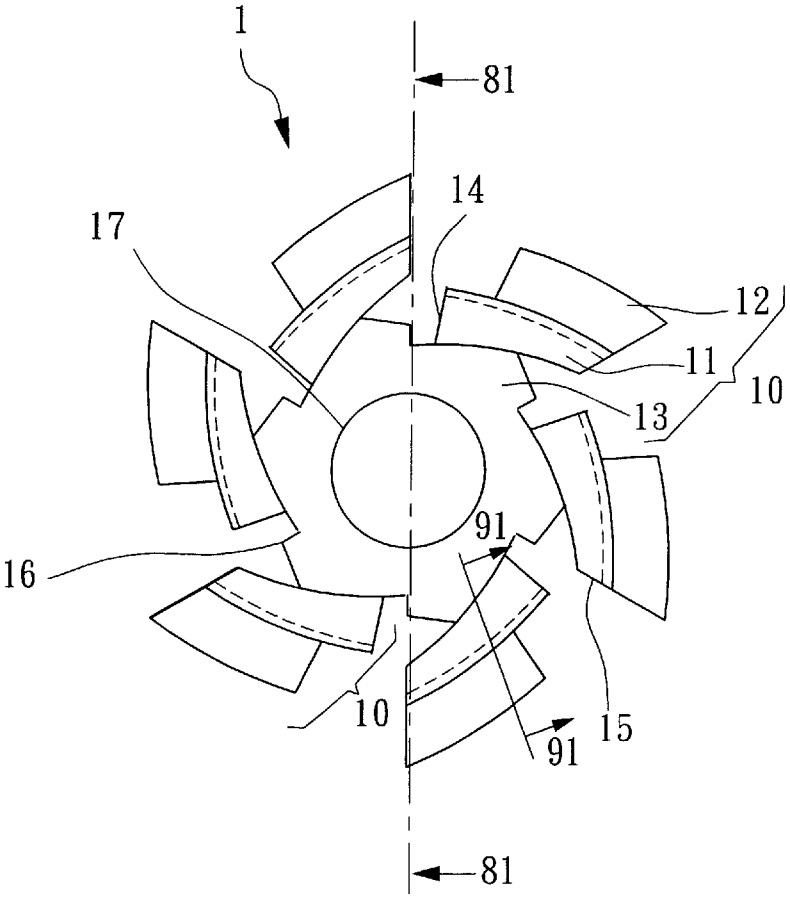
FIG. 1A is a front view of an inner blade member of this invention.

Referring to FIGS. 1A, 1B and 1C, the inner blade member 1 is generally shaped in a hollow dish manner with a plurality of relatively short inner blades 10 (about a half of a conventional blade in length) extending radially outward. Each inner blade 10 has a 3D curved profile which includes (from inward to outward) an inner blade root 13, an inner blade body 11 and an inner blade shroud 12 formed in substantially a Z-shaped or counter-Z-shaped manner. The 3D curved profile is smooth and has no overlap portion. It thus may be produced by stamping operation easily. The blade root 13 joins inward to form a hub opening 17 in the center. A gear type (or other geometric form) engaging edge 16 is formed at an outer rim of the blade root 13. Each inner blade body 11 has an inner blade leading edge 14 and an inner blade trailing edge 15. The inner blade shroud 12 is shaped to mate with the impeller front cover 6. The inner blade root 13 has a curved side for soldering to the impeller rear cover 7.

Figure 2C:
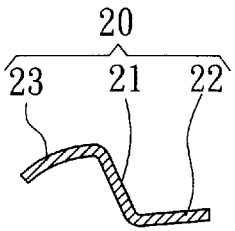
FIG. 2C is a crosssectional view taken on line 92—92 of FIG. 2A.
Figure 2B:
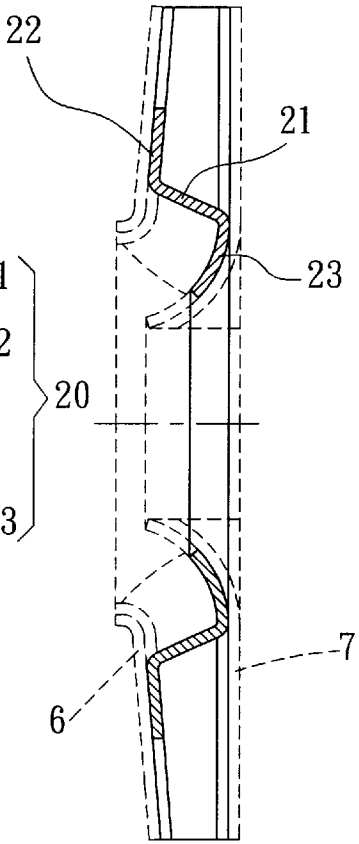
FIG. 2B is a crosssectional view taken on line 82—82 of FIG. 2A.
Figure 2A:
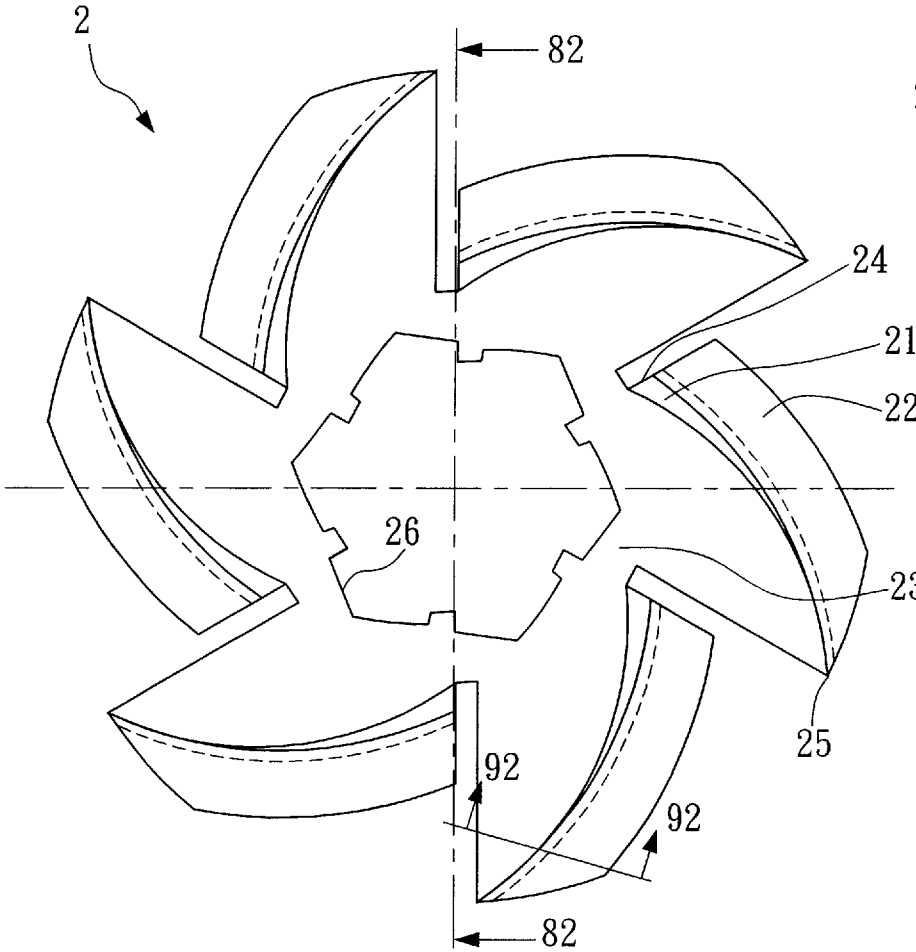
FIG. 2A is a front view of an outer blade member of this invention.

Referring to FIGS. 2A, 2B and 2C, the outer blade member 2, like the inner blade member 1, is also shaped in a hollow dish manner with a plurality of outer blades 20 extending radially outward. Each outer blade 20 has a 3D profile which includes (from inward to outward) an outer blade root 23, an outer blade body 21 and an outer blade shroud 22 forming in substantially a Z-shaped or counter-Z-shaped manner. The outer blade roots 23 join inward and form a center mate opening 26 which has a mating edge engageable with the engaging edge 16. Each outer blade body 21 has an outer blade leading edge 24 and an outer blade trailing edge 25. The outer blade shroud 22 is also shaped to mate with the impeller front cover 6.

Figure 3C:
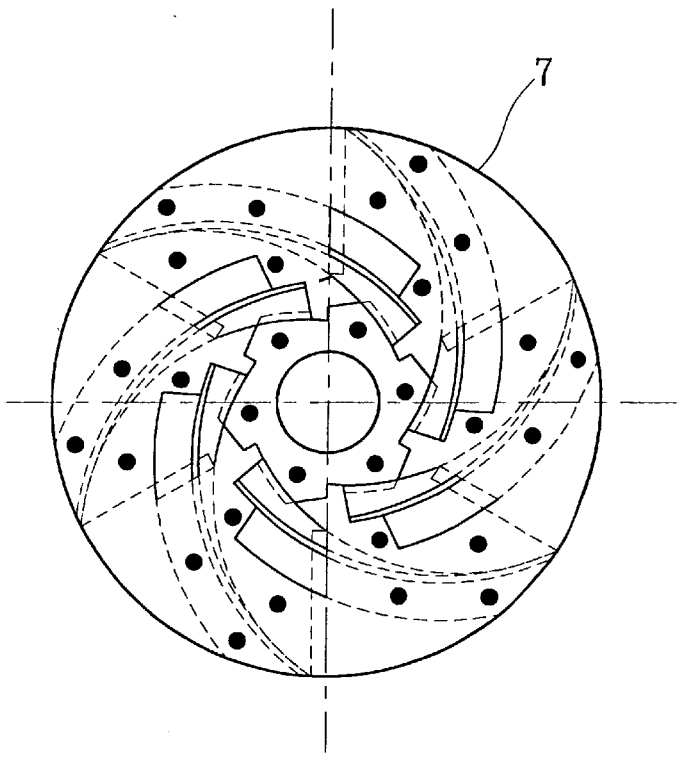
FIG. 3C is a rear view of the impeller shown in FIG. 3A.
Figure 3B:
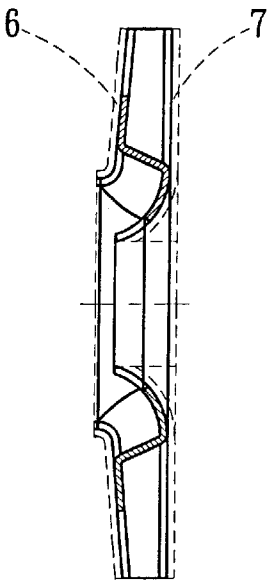
FIG. 3B is a crosssectional view taken on line 83—83 of FIG. 3A.
Figure 3A:
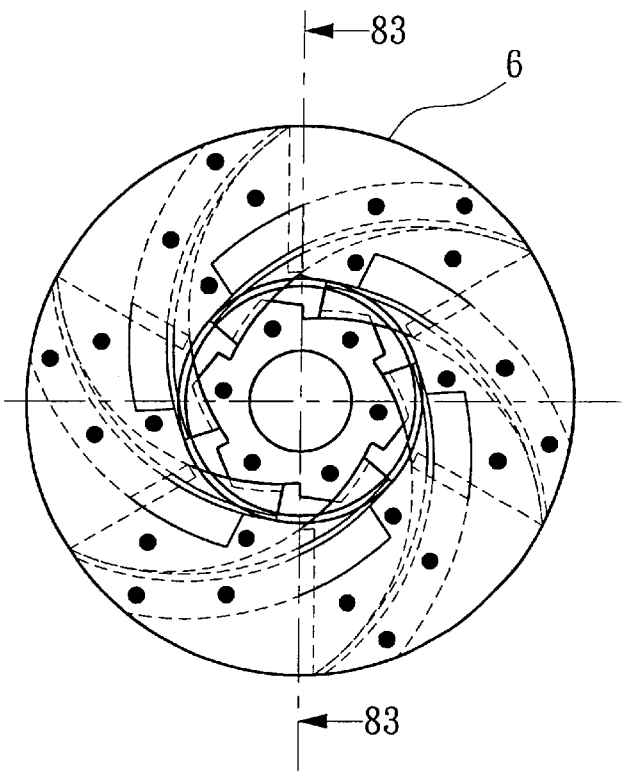
FIG. 3A is a front view of an impeller of this invention.

Referring to FIGS. 3A, 3B and 3C, the inner blade member 1 may be stacked and engage with the outer blade member 2 easily and quickly by mating the hub opening 17 with the mating opening 26, and aligning the engaging edge 16 with the mating edge. The inner blade trailing edge 15 may be mated and engaged with the outer blade leading edge 24 to form a complete and smooth impeller blade. Then the inner and outer blade shrouds 12 and 22 may be spot welded to the front cover 6 while the inner and outer root 13 and 23 may be spot welded (indicated by black circle spots in FIG. 3A and 3C) to the rear cover 7. The assembly and spot-weld may be done quickly to form a complete impeller. The inner blade trailing edge 15 may also moved away from the outer blade leading edge 24 during assembly and maintains a gap therebetween. Then the assembled blade member becomes a multi-row blade structure. The number of the inner blade 10 may be same or different from the outer blade 20.

FIGS. 4A through 6C show this invention for producing metal working diffuser. It is generally structured and produced like the one shown in FIGS. 1A through 3C for the impeller. Instead of impeller blades, diffuser vanes are made. Only main difference will be depicted hereunder, details of similar structure and features will be omitted.

Figure 4B:
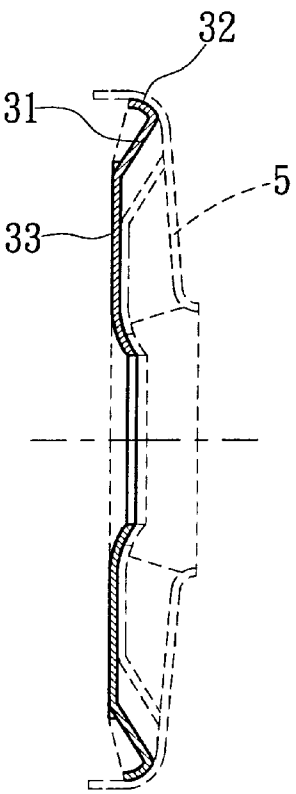
FIG. 4B is a crosssectional view taken on line 84—84 of FIG. 4A.
Figure 4A:
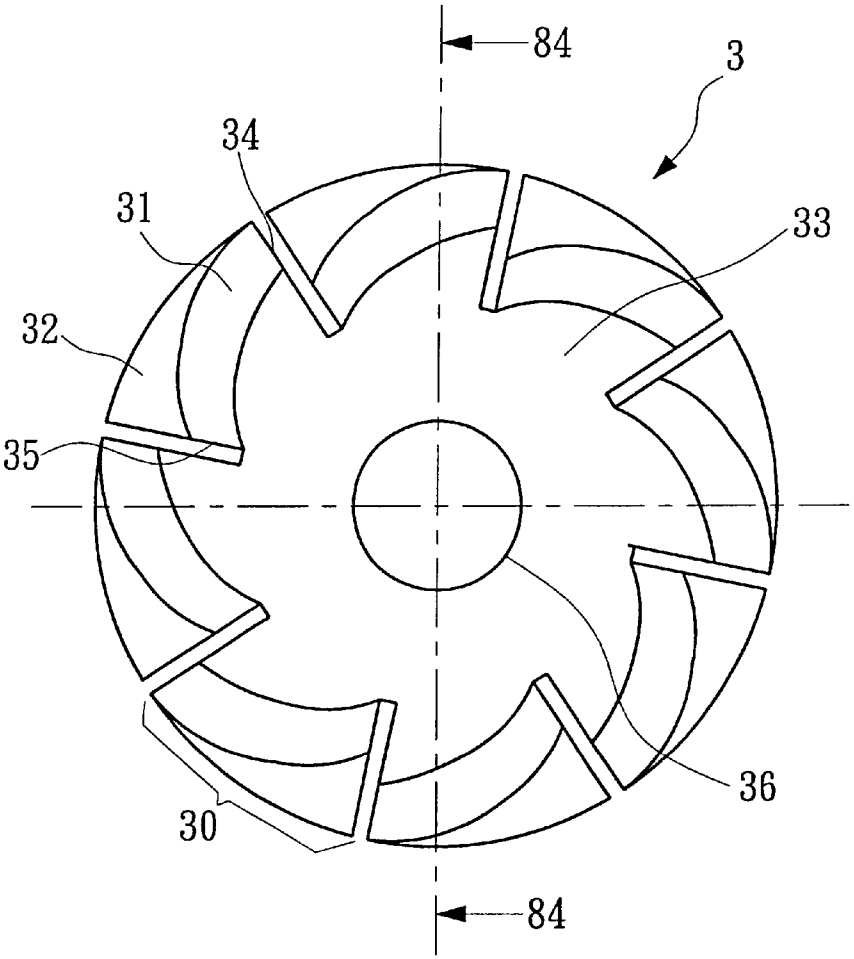
FIG. 4A is a front view of an outer diffuser of this invention.

FIGS. 4A and 4B show a hollow dish shaped outer diffuser 3 which includes a plurality of radial and Z-shaped outer diffuser vanes 30 each has an outer vane root 33, an outer vane body 31 and an outer vane shroud 32 which is shaped and mated with a diffuser rear cover 5. The outer vane root 33 has an outer vane center hub opening 36. The outer vane body 31 has an outer vane leading edge 34 and an outer vane trailing edge 35.

Figure 5B:
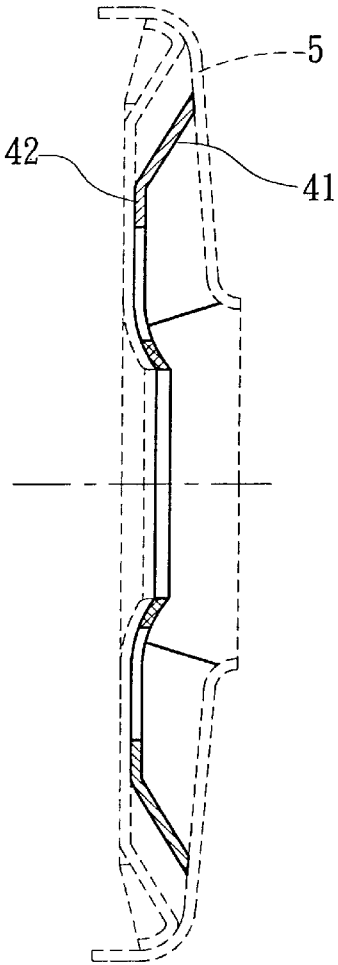
FIG. 5B is a crosssectional view taken on line 85—85 of FIG. 5A.
Figure 5A:
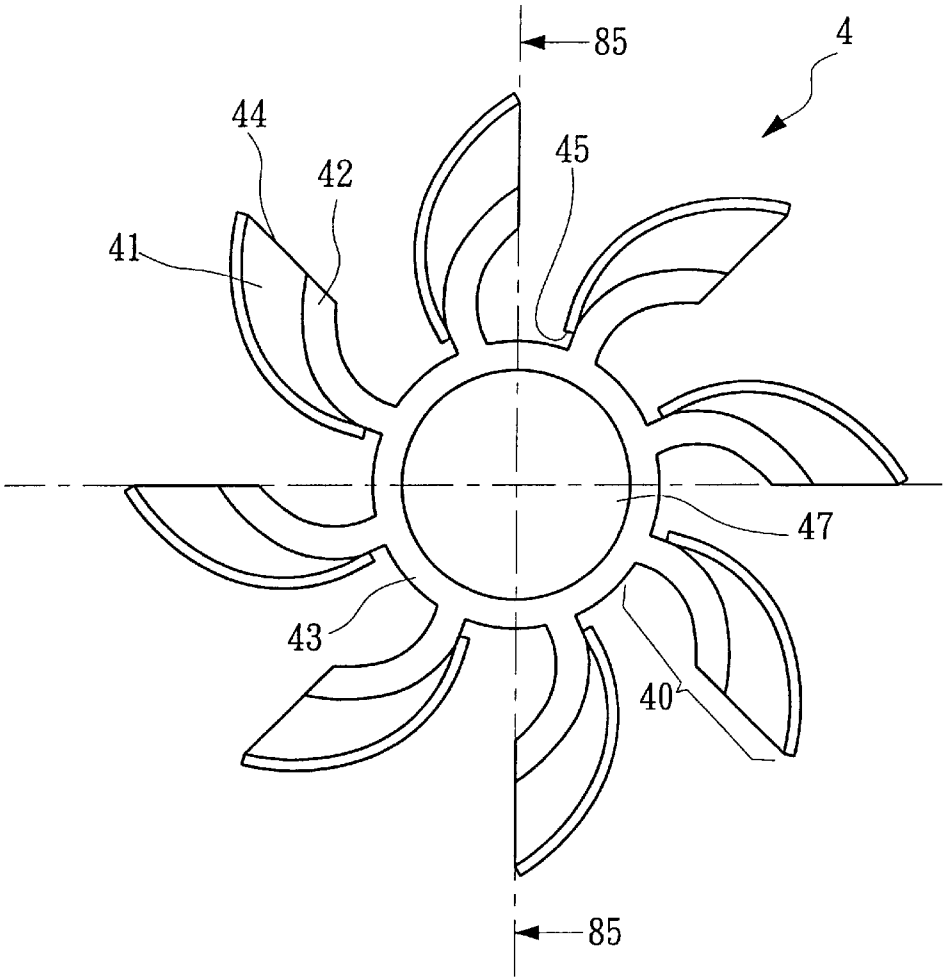
FIG. 5A is a front view of an inner diffuser of this invention.
Figure 6B:
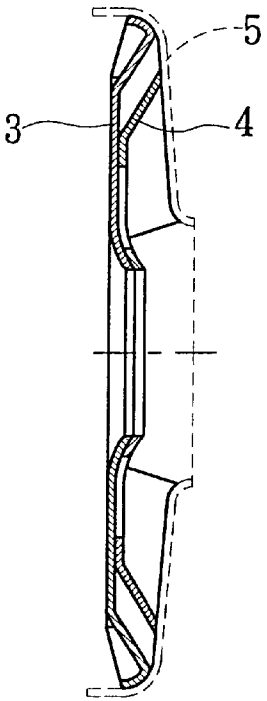
FIG. 6B is a crosssectional view taken on line 86—86 of FIG. 6A.
Figure 6A:
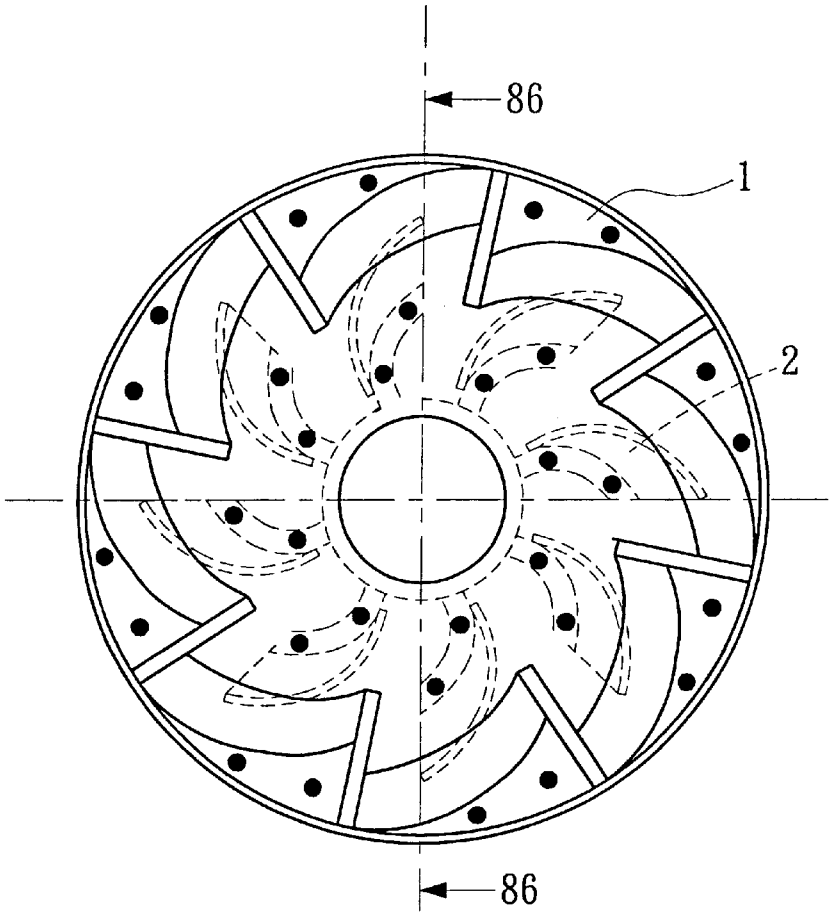
FIG. 6A is a front view of a diffuser of this invention.
Figure 6C:
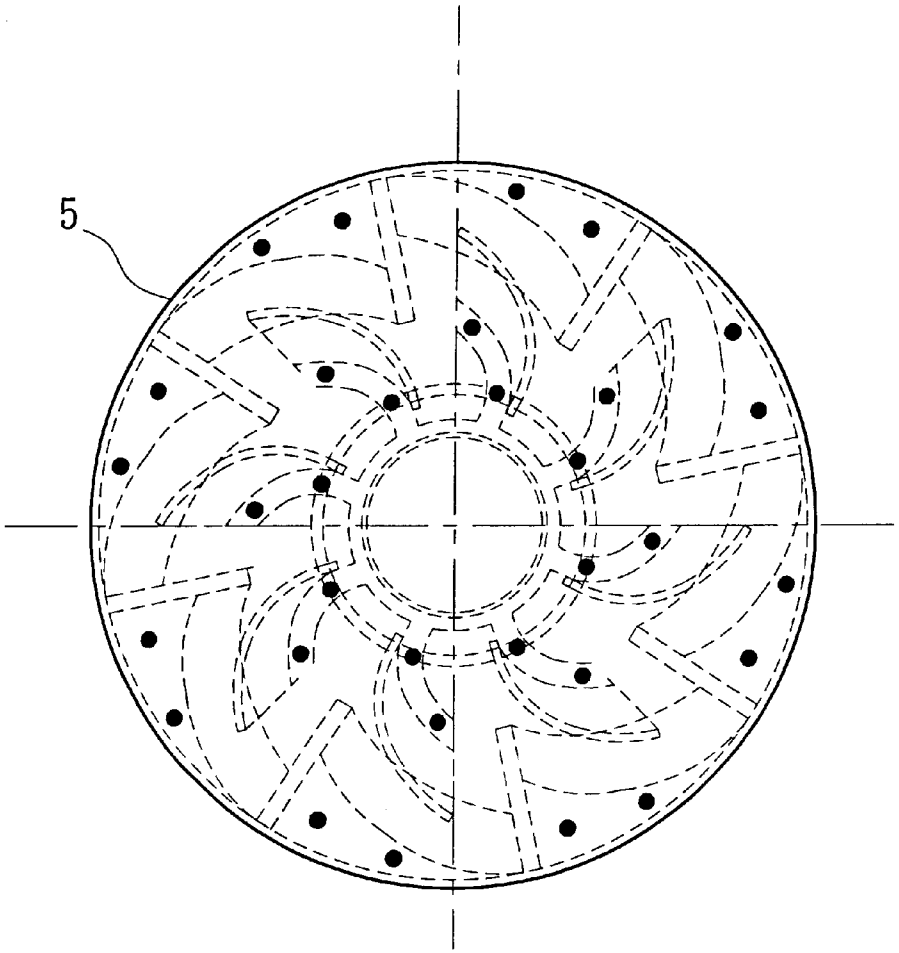
FIG. 6C is a rear view of the diffuser shown in FIG. 6A.

FIGS. 5A and 5B show an inner diffuser 4 which includes a plurality of radial and L-shaped inner diffuser vanes 40 each has an inner vane root 42, an inner vane body 41 and a base 43 which forms an inner vane opening 47 in the center. Each inner vane body 41 has an inner vane leading edge 44 and an inner vane trailing edge 45.

When making the assembly, the outer diffuser 3 is axially stacked on the inner diffuser 3 by mating the outer vane center hub opening 36 with the inner vane opening 47 (shown in FIGS. 6A, 6B and 6C), and with the inner vane root 42 and base 43 resting on the outer vane root 33. Then spot welding is done on the root and base (black circle spots in FIG. 6A) to bind the inner and outer diffuser 3 and 4 together. Afterward, the outer vane shroud 32 is spot welded or soldered to the diffuser rear cover 5. This operation may be done easily and quickly without conventional vane positioning problem.

When the outer vane trailing edge 35 mates closely with the inner vane leading edge 44, the diff-user has a smooth and complete diffuser vane. When the trailing edge 35 is moved away from the leading edge 44 and forms a gap therebetween, it becomes a multi-row vane. The number of the inner diffuser vane 40 may be same or different from the outer diffuser vane 30.

Figure 7:
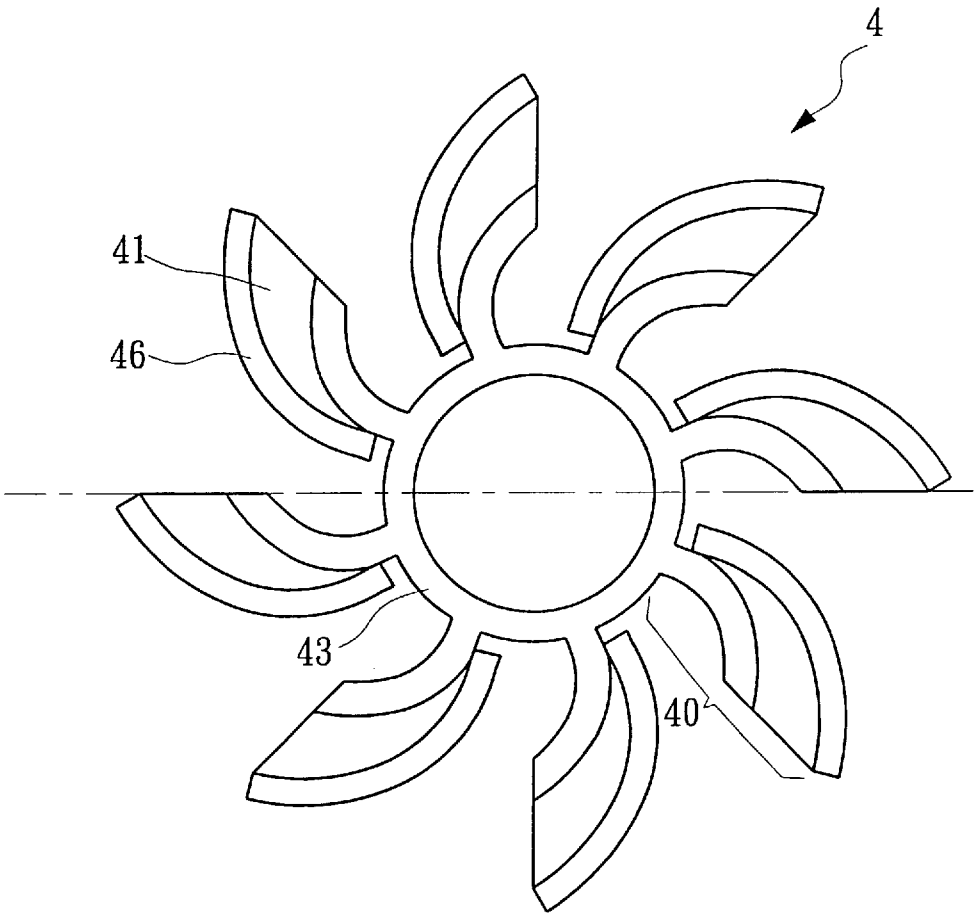
FIG. 7 is a front view of another embodiment of an inner diffuser of this invention.

FIGS. 5A and 5B show the inner vane body 41 having an outer edge making contact directly with the diffuser rear cover 5. Such a structure may withstand relatively low fluid pressure. For supporting high fluid pressure, it is preferably to add an inner vane shroud 46 extending beyond the inner vane body 41 (FIG. 7). The inner vane shroud 46 may be mated and welding to the diffuser rear cover 5 for enhancing pressure sustaining capability.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. An integrally formed stamped sheet-metal blade having 3D structure, comprising:

an inner blade member formed as a hollow dish and having a plurality of 3D inner blades extending radially outward, each inner blade including from inward to outward an inner blade root and an inner blade body which bends at an angle with respect to the inner blade root, the inner blade roots forming a center hub opening which has an engaging edge, the inner blade bodies having inner blade leading edges and inner blade trailing edges; and an outer blade member formed as a hollow dish and having a plurality of 3D outer blades extending radially outward, each outer blade including from inward to outward an outer blade root and an outer blade body, the outer blade roots forming a center mating opening having a mating edge, the outer blade bodies having outer blade leading edges and outer blade trailing edges;

wherein the mating edge engages the engaging edge when the center hub opening mates with the center mating opening to mate and engage the outer blade member with the inner blade member and forming an integral sheet-metal blade assembly, the inner blade trailing edges mating and engaging with the outer blade leading edges.

2. The integrally formed stamped sheet-metal blades of claim 1, further comprising an impeller front cover and an impeller rear cover sandwiching the inner and outer blade members therebetween.

3. The integrally formed stamped sheet-metal blades of claim 2, wherein the inner blade member further comprises an inner blade shroud extending at an angle from the inner blade bodies and mating with the impeller front cover to facilitate positioning of the inner blade member in the impeller assembly.

4. The integrally formed stamped sheet-metal blades of claim 2, wherein the outer blade member further comprises an outer blade shroud extending at an angle from the outer blade bodies and mating with the impeller front cover to facilitate positioning of the outer blade member in the impeller assembly.

5. The integrally formed stamped sheet-metal blades of claim 3, wherein the inner blade has a Z-shaped crosssection.

6. The integrally formed stamped sheet-metal blades of claim 2, wherein the inner and outer blade bodies are fixedly positioned between the impeller front and rear cover by welding.

7. The integrally formed stamped sheet-metal blades of claim 6, wherein the welding is spot welding.

8. The integrally formed stamped sheet-metal blades of claim 1, wherein the engaging edge is a tooth form.

9. An integrally formed stamped sheet-metal blade having 3D structure, comprising:

an inner blade member formed as a hollow dish and having a plurality of 3D inner blades extending radially outward, each inner blade including from inward to outward an inner blade root and an inner blade body which bends at an angle with respect to the inner blade root, the inner blade roots forming a center hub opening which has an engaging edge, the inner blade bodies having inner blade leading edges and inner blade trailing edges; and an outer blade member formed as a hollow dish and having a plurality of 3D outer blades extending radially outward, each outer blade including from inward to outward an outer blade root and an outer blade body, the outer blade roots forming a center mating opening having a mating edge, the outer blade bodies having outer blade leading edges and outer blade trailing edges;

wherein the mating edge engages the engaging edge when the center hub opening mates with the center mating opening to mate and engage the outer blade member with the inner blade member and forming an integral sheet-metal blade assembly, the inner blade trailing edges being spaced from the outer blade leading edges.

10. The integrally formed stamped sheet-metal blades of claim 9, further comprising an impeller front cover and an impeller rear cover sandwiching the inner and outer blade members therebetween.

11. The integrally formed stamped sheet-metal blades of claim 10, wherein the inner blade member further comprises an inner blade shroud extending at an angle from the inner blade bodies and mating with the impeller front cover to facilitate positioning of the inner blade member in the impeller assembly.

12. The integrally formed stamped sheet-metal blades of claim 10, wherein the outer blade member further comprises an outer blade shroud extending at an angle from the outer blade bodies and mating with the impeller front cover to facilitate positioning of the outer blade member in the impeller assembly.

13. The integrally formed stamped sheet-metal blades of claim 11, wherein the inner blade has a Z-shaped crosssection.

14. The integrally formed stamped sheet-metal blades of claim 10, wherein the inner and outer blade bodies are fixedly positioned between the impeller front and rear cover by welding.

15. The integrally formed stamped sheet-metal blades of claim 14, wherein the welding is spot welding.

16. The integrally formed stamped sheet-metal blades of claim 9, wherein the engaging edge is a tooth form.

* * * * *